United States Patent [19]

Hooser

[11] 4,293,055

[45] Oct. 6, 1981

[54] RETRACTABLE SAFETY HANDLE MEANS FOR A LADDER

[76] Inventor: Oneida O. Hooser, 313 N. Church (Brooklyn), Mooresville, Ind. 46158

[21] Appl. No.: 123,301

[22] Filed: Feb. 21, 1980

[51] Int. Cl.[3] ..... E06C 7/18
[52] U.S. Cl. ..... 182/106
[58] Field of Search ..... 182/106

[56] References Cited

U.S. PATENT DOCUMENTS

| | | | |
|---|---|---|---|
| 626,839 | 6/1899 | Lyke | 182/106 |
| 3,139,155 | 6/1964 | Skeels | 182/106 |

*Primary Examiner*—Reinaldo P. Machado
*Attorney, Agent, or Firm*—Robert A. Spray

[57] ABSTRACT

A retractable safety handle means for a ladder having a hinge means permitting horizontal movement in and between its retracted and its extended or handle-providing positions, and providing sturdiness of bracing even though retractable for ease of transport and storage.

15 Claims, 10 Drawing Figures

RETRACTABLE SAFETY HANDLE MEANS FOR A LADDER

The present invention relates to a safety handle means for a ladder, particularly useful for folding step-ladders.

Concepts of the invention provide a sturdy and sturdily-supported safety ladder means for a ladder, particularly a foldable stepladder; and more particular concepts provide that the handle is easily movable between an extended or handle-forming position and a retracted position in which it is closely adjacent the ladder itself so as to provide a low-bulk and low-size condition for transport or storage.

The sturdiness of the handle, as provided by the particulars of the support members which provide the ladder-attached mounts for the handle, provides high safety benefits for the use.

The safety aspects are of particular benefit when using the concepts with a folding stepladder; for many ladders of that type are used domestically, by persons or children who are not accustomed to using a ladder and/or who are not sufficiently familiar with principles of safety in the use of ladders, or who might be careless in ladder use, or who might not realize the dangers inherent in use of a ladder in climbing to a height of merely only a foot or two above the floor.

In carrying out the invention, the concepts provide an elongated handle member of a length to span a plurality of steps of the ladder, with sturdy support means for securely supporting handle member by the ladder at at least two vertically-spaced locations, achieving much sturdiness. A hinge means is associated with each of the supports, and the hinges are located with respect to the ladder and handle member such that the handle member may be easily and conveniently moved, in an easy horizontal swinging movement, in and between a handle-operable position relatively non-adjacent the ladder and a retracted position relatively adjacent the ladder.

In that retracted position, the overall ladder and handle are then of a reduced shape and size, as desirable for storage and/or transport thereof. However, there is no dis-assembly of the handle member from the ladder; and no re-assembly thereof to the ladder is necessary when desiring to use the ladder with a handle in handle-forming position.

Extra support is achieved by a latch means which latchingly retains the handle-operable position of the handle member once it is established.

The above description is of introductory nature, and is thus somewhat generalized. More particular objects, concepts, features, and details will be more apparent from the following, more detailed description of an illustrative embodiment, reference being had to the accompanying somewhat schematic drawings, in which.

Figure 1:
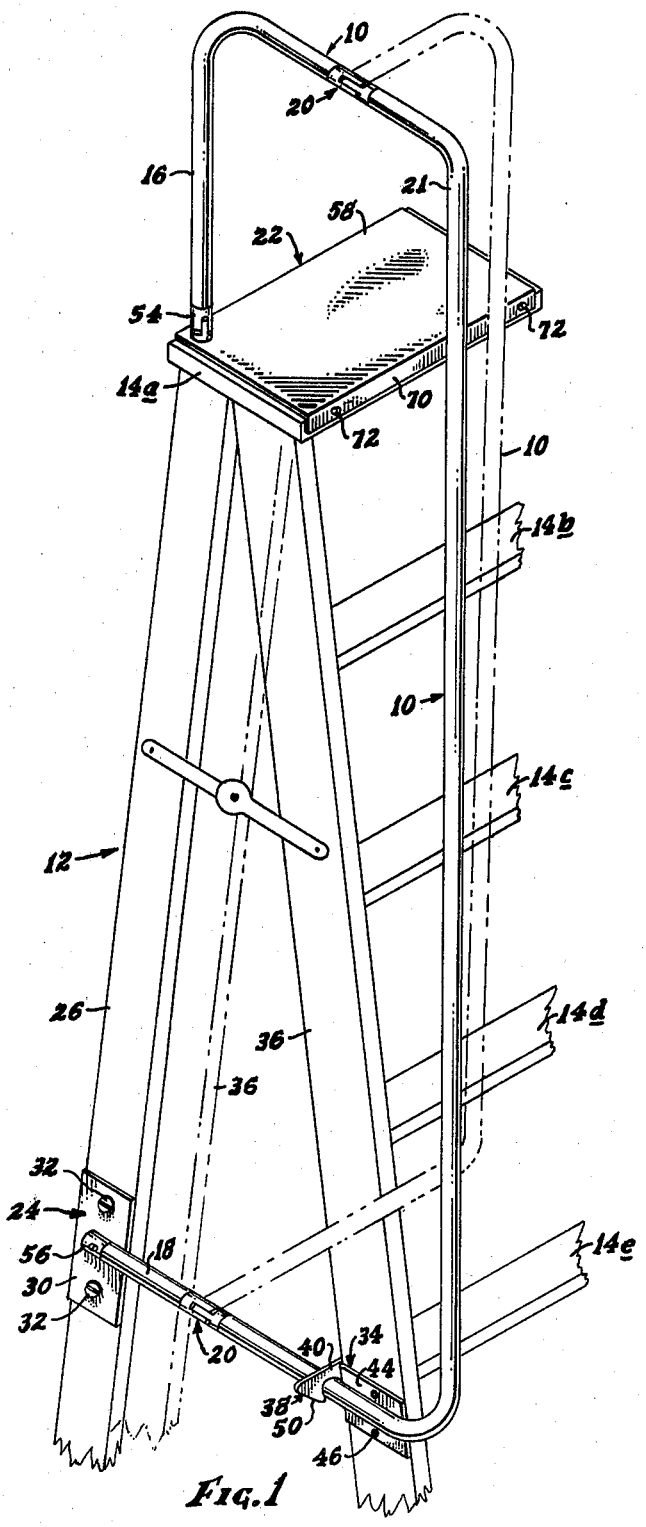
FIG. 1 is a pictorial illustration of a stepladder which has assembled thereto a movable safety means according to an illustrative embodiment of the inventive concepts, the handle being shown in full lines in its extended or handle-forming position, and the handle and the front leg unit of the ladder being shown in chain lines in retracted position.
Figure 2:
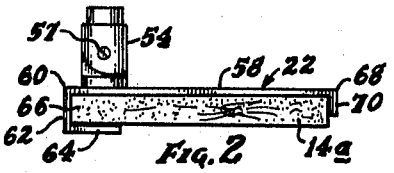
FIG. 2 is an end view of a support or mounting means shown in FIG. 1 as attached to the top step of a stepladder.
Figure 3:
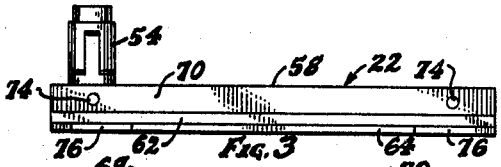
FIGS. 3 and 4 are other views of the mounting support of FIG. 2, but removed from the ladder step, FIG. 3 being a front elevational view thereof, and FIG. 4 being an undesirable plan view.
Figure 4:
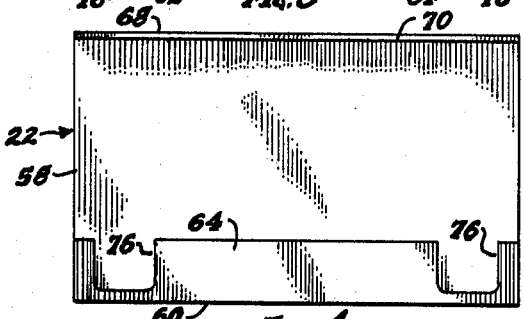
Figure 5:
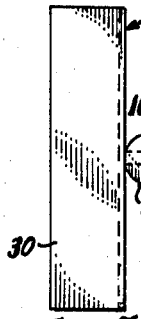
FIG. 5 is a rear elevational view of a lower support member of FIG. 1, which provides support for the lower portion of the handle.
Figure 6:
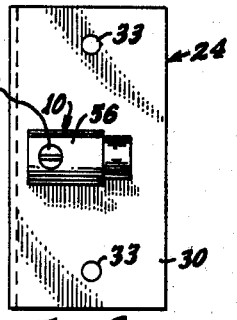
FIG. 6 is a side elevational view of the lower support shown in FIG. 5.
Figure 7:
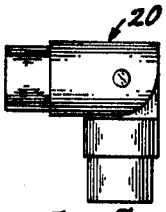
FIG. 7 is a view of the hinge of the handle of FIG. 1, shown in the folded condition.
Figure 8:
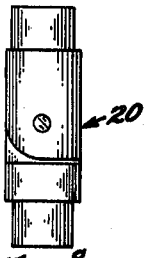
FIG. 8 illustrates the handle hinge of FIG. 7 in straight condition.
Figure 9:
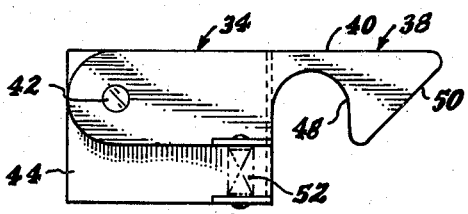
FIG. 9 is a rear elevational view of a latch support member of FIG. 1.
Figure 10:
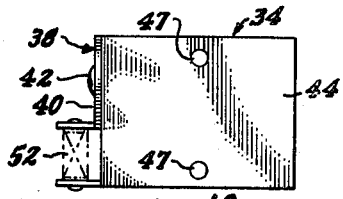
FIG. 10 is a side elevational view of the latch member shown in FIGS. 1 and 9.

As shown in the drawings, the inventive concepts provide an advantageous and retractable safety handle means 10 for a ladder 12, the ladder 12 shown being a foldable stepladder which otherwise is of conventional construction except as provided with the safety handle 10 and its supports herein illustrated by this embodiment.

The elongated handle member 10 is of a length to span a plurality of the steps 14 of the ladder 12; and for descriptive convenience the steps are here identified by reference numbers 14*a*, 14*b*, etc., downwardly from the top step 14*a*.

There are shown as provided support means for securely supporting the handle member 10 to the ladder 12 at at least two locations vertically spaced along the ladder 12; and the support means are shown as an upper support means 16 and a lower support means 18. Each of the support means 16–18 includes attaching means, specified hereinafter, for attaching the handle's support means 16–18 to the ladder 12 at the support locations.

A hinge means 20 is associated with each of the support means 16–18, and the hinges 20 are located with respect to the ladder 12 and handle member 10 in a manner such that the handle member 10 may be swung or rotated horizontally and positioned in and between an handle-operable position (shown in full lines) which is easily reachable to the user of the ladder 12, being relatively non-adjacent the ladder, and a retracted position (shown in chain lines) which is relatively adjacent the ladder 12.

This movability of the handle 10 thereby provides that in the handle-operable position of the handle member 10, the handle member 10 may be manually grasped by the use of the ladder 12 as a sturdy and sturdily-supported handle for the ladder, but provides also that in the retracted position of the handle member 10 it is retracted operatively adjacent the ladder 12 thereby providing a reduced shape and size of the combination of ladder and handle member, such as for storage and/or transport thereof; yet the achievement of that reduced shape and reduced size of the ladder does not require dis-assembly of the handle member 10 from the ladder 12, nor does it require re-assembly of the handle 10 to the ladder 12 when desiring to use the ladder with handle provided therefor.

Desirably, as shown the handle member 10 extends upwardly (portion 21) above the top step 14*a* of the ladder 12, providing safety for the ladder user particularly in the high locations of stance on the ladder 12; and the uppermost of the attaching means 22 is secured to the top step 14*a* of the ladder 12.

Sturdily supporting the handle 10, the attaching means 24 which is below the uppermost one 22 is attached to the rear leg 26 of the ladder 12, that attachment being shown as an L-shaped plate 30 attached by screws 32, passing through plate-holes 33.

In the illustrative embodiment, extra supporting means 34 for the handle member 10 are also provided, attached to the front leg 36 of the ladder 12, for providing extra support and sturdiness for the handle member 10 by giving extra support to the support means below the uppermost support means 16. This extra supporting means 34 is show as including a latch means 38 which latchingly retains the handle-operable (full-line) position of the handle member 10 once it is established; and this thereby assures against inadvertent or other untimely retraction of the handle member 10 from its handle-operable position.

The latch 38 is shown as including a movable plate 40 pivoted by pin 42 to an attachment plate 44 held to the front ladder-leg 36 by screws 46; and the plate 40, which is of L-shape, has screw-holes 47 for screws 46, and also a cut-out 48 which receives the adjacent portion of the handle or support rod thereof. The plate 40 has an inclined edge 50 which, when engaged by the handle or support rod in the movement of the handle 10 to its extended or handle-forming position, causes the movable plate 40 to withdraw to a position permitting entry of the handle or support to that position; and a spring 52 pulls the plate 40 to a latching position in which the recess 48 holds the handle or support against the movement out of handle-forming position.

Further safety is provided by the concepts by which, in the retracted (chain-line) position of the handle member 10, it and/or a portion of its support means 16–18 operatively overlies a portion of the ladder 12 (such as steps 14*a*, 14*b*, 14*c*, etc.) which otherwise would be likely encountered by a person using the ladder 12; and this overlieing thus at least discourages a use of the ladder 12 except with the handle member 10 in its handle-operable (full-line) position, and this enhances safety considerations of the use of the ladder 12.

The attachments 22–24 by a pivotable nature of the respective sockets 54–56, are shown of a pivotal nature, particularly in the case of use with a folding stepladder; for many of that type of folding ladder have a relative movement of their top step 14*a* (to which the upper attachment 22 is affixed) and the ladder-leg (here the rear one 26) to which the lower attachment 24 is affixed. The pivoting permitted by the attachments 22–24 accommodates that corresponding dimensional change, both having pivot pins 57.

Sturdiness of the attachment 22 to the top ladder step 14*a* is shown by the provision of the attachment 22 as a plate 58 having along its rear edge 60 a down-turn 62 then a forward-turn 64, providing a pocket, into which the rear 66 of the top step 14*a* is inserted, and by the front edge 68 being turned downwardly to provide a vertical lip 70. Only a few screws 72 are needed in this type attachment to achieve great sturdiness, the screw holes 74 for the screws 72 being shown provided in the lip 70. The underlying plate-portion 64 is shown as suitably notched as at 76 to accommodate the rear ladder-legs 26.

If desired, convenience of installation of the retractable ladder-handle and its supports may be facilitated by supplying clamp means (such as C-clamps) for the screws or bolts (32, 46, 72) mentioned above; and this avoids the need to drill holes.

It is thus seen that a retractable safety handle means according to the inventive concepts provides a desired and advantageous device, yielding the high benefits and advantages of a safety handle device for a ladder. It is sturdy, and is readily assembled or installed onto existing ladders, and has special safety benefits and applicability to a folding stepladder. It retractability and extendability provide extra advantages, as mentioned herein.

Accordingly, it will thus be seen from the foregoing description of the invention according to this illustrative embodiment, considered with the accompanying drawings, that the present invention provides new and useful concepts of a retractable handle means for a ladder, which is easily changed from retracted position to handle-forming condition, and with ease and convenience of use, yielding desired advantages and characteristics, and accomplishing the intended objects, including those hereinbefore pointed out and others which are inherent in the invention.

Modifications and variations may be effected without departing from the scope of the novel concepts of the invention; accordingly, the invention is not limited to the specific embodiment or form or arrangement of parts herein described or shown.

What is claimed is:

1. Retractable safety handle means for a ladder, comprising, in combination:

an elongated handle member of a length to span a plurality of steps of the ladder;

support means securely supporting the handle member to the ladder at at least two locations vertically spaced along the ladder;

the support means including attaching means attaching the handle's support means to the ladder at the said locations;

a hinge means associated with each of the said support means, and located with respect to the ladder and handle member in a manner such that the handle member may be positioned in and between a handle-operable position relatively non-adjacent the ladder and a retracted position relatively adjacent the ladder;

the parts thereby providing, that in the handle-position of the handle member, the handle member may be manually grasped by the user of the ladder as a sturdy and sturdily-supported handle for the ladder, but providing that in the retracted position of the handle member it is retracted operatively adjacent the ladder thereby providing a reduced shape and size of the combination of ladder and handle member as for storage and/or transport thereof, but not requiring dis-assembly of the handle member from the ladder, nor re-assembly thereof to the ladder when desiring to use the ladder with a handle provided therefor;

the hinge means and support means providing that the axis of the hinge means is generally vertical and that the movement of the handle member between its said handle-operable position and its said retracted position is generally horizontal without any significant amount of vertical movement, and thereby avoiding any significant amount of handle-raising effort or handle-lowering effort.

2. The invention as set forth in claim 1 in a combination in which the ladder is a foldable step ladder.

3. The invention as set forth in claim 2 in a combination in which the handle member extends upwardly above the top step of the ladder.

4. The invention as set forth in claim 2 in a combination in which the uppermost of the attaching means is secured to the top step of the ladder.

5. The invention as set forth in claim 2 in a combination in which attaching means below the uppermost one are attached to a rear leg of the ladder.

6. The invention as set forth in claim 4 in a combination in which attaching means below the uppermost one are attached to a rear leg of the ladder.

7. The invention as set forth in claim 5 in a combination in which extra supporting means for the handle member are also provided, attached to a front leg of the ladder, for providing extra support and sturdiness for the handle member by giving extra support to support means below the uppermost support means.

8. The invention as set forth in claim 7 in a combination in which the said extra supporting means include a latch means which latchingly retains the handle-operable position of the handle member once it is established, thereby assuring against inadvertent or other untimely retraction of the handle member from its handle-operable position.

9. The invention as set forth in claim 2 in a combination in which there are provided latch means which latchingly retains the handle-operated position of the handle member once it is established, thereby assuring against inadvertent or other untimely retraction of the handle member from its handle-operable position.

10. Retractable safety handle means for a ladder, comprising, in combination:

an elongated handle member of a length to span a plurality of steps of the ladder;

support means securely supporting the handle member to the ladder at at least two locations vertically spaced along the ladder;

the support means including attaching means attaching the handle's support means to the ladder at the said locations;

a hinge means associated with each of the said support means, and located with respect to the ladder and handle member in a manner such that the handle member may be positioned in and between a handle-operable position relatively non-adjacent the ladder and a retracted position relatively adjacent the ladder;

the parts thereby providing, that in the handle-operable position of the handle member, the handle member may be manually grasped by the use of the ladder as a sturdy and sturdily-supported handle for the ladder, but providing that in the retracted position of the handle member it is retracted operatively adjacent the ladder thereby providing a reduced shape and size of the combination of ladder and handle member as for storage and/or transport thereof, but not requiring dis-assembly of the handle member from the ladder, nor re-assembly thereof to the ladder when desiring to use the ladder with a handle provided therefor;

in a combination in which, in the retracted position of the handle member, it and/or a portion of its support means operatively overlies a portion of the ladder which otherwise would be likely encountered by a person using the ladder, thereby at least discouraging use of the ladder except with the handle member in its handle-operable position, thus enhancing safety considerations in the use of the ladder.

11. Retractable safety handle means for a ladder, comprising, in combination:

an elongated handle member of a length to span a plurality of steps of the ladder;

support means securely supporting the handle member to the ladder at at least two locations vertically spaced along the ladder;

the support means including attaching means attaching the handle's support means to the ladder at the said locations;

a hinge means associated with each of the said support means, and located with respect to the ladder and handle member in a manner such that the handle member may be positioned in and between a handle-operable position relatively non-adjacent the ladder and a retracted position relatively adjacent the ladder;

the parts thereby providing, that in the handle-operable position of the handle member, the handle member may be manually grasped by the user of the ladder as a sturdy and sturdily-supported handle for the ladder, but providing that in the retracted position of the handle member it is retracted operatively adjacent the ladder thereby providing a reduced shape and size of the combination of ladder and handle member as for storage and/or transport thereof, but not requiring disassembly of the handle member from the ladder, nor re-assembly thereof to the ladder when desiring to use the ladder with a handle provided therefor;

in which the ladder is a foldable step ladder, and in which the uppermost of the attaching means is secured to the top step of the ladder;

in a combination in which the attaching means, which is secured to the top step of the ladder, is provided in the form of a plate means which overlies the said top step, an edge of said plate means being provided with a down-turned portion from which extends a horizontal portion, providing a pocket into which an edge of the top step may be fitted or inserted.

12. The invention as set forth in claim 11 in which another edge of the plate means is provided with a down-turned lip means, and securing means pass through said lip means and into the said top step for securely attaching the attaching means to the top ladder step.

13. Retractable safety handle means for a ladder, comprising, in combination:

an elongated handle member of a length to span a plurality of steps of the ladder;

support means securely supporting the handle member to the ladder at at least two locations vertically spaced along the ladder;

the support means including attaching means attaching the handle's support means to the ladder at the said locations;

a hinge means associated with each of the said support means, and located with respect to the ladder and handle member in a manner such that the handle member may be positioned in and between a handle-operable position relatively non-adjacent the ladder and a retracted position relatively adjacent the ladder;

the parts thereby providing, that in the handle-operable position of the handle member, the handle member may be manually grasped by the user of the ladder as a sturdy and sturdily-supported handle for the ladder, but providing that in the retracted position of the handle member it is retracted operatively adjacent the ladder thereby providing a reduced shape and size of the combination of ladder and handle member as for storage and/or transport thereof, but not requiring disassembly of the handle member from the ladder, nor re-assembly thereof to the ladder when desiring to use the ladder with a handle provided therefor;

the hinge means and support means providing that the axis of the hinge means is generally vertical and that the movement of the handle member between its said handle-operable position and its said retracted position is generally horizontal without any significant amount of vertical movement, and thereby avoiding any significant amount of handle-raising effort or handle-lowering effort;

in a combination in which, in the retracted position of the handle member, it and/or a portion of its support means operatively overlies a portion of the ladder which otherwise would be likely encountered by a person using the ladder, thereby at least discouraging use of the ladder except with the handle member in its handle-operable position, thus enhancing safety considerations in the use of the ladder.

14. Retractable safety handle means for a ladder, comprising, in combination:

an elongated handle member of a length to span a plurality of steps of the ladder;

support means securely supporting the handle member to the ladder at at least two locations vertically spaced along the ladder;

the support means including attaching means attaching the handle's support means to the ladder at the said locations;

a hinge means associated with each of the said support means, and located with respect to the ladder and handle member in a manner such that the handle member may be positioned in and between a handle-operable position relatively non-adjacent the ladder and a retracted position relatively adjacent the ladder;

the parts thereby providing, that in the handle-operable position of the handle member, the handle member may be manually grasped by the user of the ladder as a sturdy and sturdily-supported handle for the ladder, but providing that in the retracted position of the handle member it is retracted operatively adjacent the ladder thereby providing a reduced shape and size of the combination of ladder and handle member as for storage and/or transport thereof, but not requiring disassembly of the handle member from the ladder, nor re-assembly thereof to the ladder when desiring to use the ladder with a handle provided therefor;

the hinge means and support means providing that the axis of the hinge means is generally vertical and that the movement of the handle member between its said handle-operable position and its said retracted position is generally horizontal without any significant amount of vertical movement, and thereby avoiding any significant amount of handle-raising effort or handle-lowering effort;

in which the ladder is a foldable step ladder, and in which the uppermost of the attaching means is secured to the top step of the ladder;

in a combination in which the attaching means, which is secured to the top step of the ladder, is provided in the form of a plate means which overlies the said top step, an edge of said plate means being provided with a down-turned portion from which extends a horizontal portion, providing a pocket into which an edge of the top step may be fitted or inserted.

15. The invention as set forth in claim 14 in which another edge of the plate means is provided with a down-turned lip means, and securing means pass through said lip means and into the said top step for securely attaching the attaching means to the top ladder step.

* * * * *